US005365043A

United States Patent [19]

Bradford

[11] Patent Number: 5,365,043

[45] Date of Patent: Nov. 15, 1994

[54] HIGH HEAT MICROWAVE OVEN SYSTEM WITH TEMPERATURE SENSOR

[75] Inventor: Gary R. Bradford, Wappingers Falls, N.Y.

[73] Assignee: North Atlantic Equipment Sales, Inc., Wappingers Falls, N.Y.

[21] Appl. No.: 786,007

[22] Filed: Oct. 31, 1991

Related U.S. Application Data

[63] Continuation-in-part of Ser. No. 726,366, Jul. 5, 1991, abandoned.

[51] Int. Cl.[5] ..... H05B 6/68

[52] U.S. Cl. ..... 219/710; 219/712; 219/756; 219/762; 374/149; 373/136

[58] Field of Search ..... 219/10.55 B, 10.55 E, 219/10.55 F, 10.55 R, 10.55 M, 710, 712, 756, 762, 763; 373/136; 374/149

[56] References Cited

U.S. PATENT DOCUMENTS

| | | | |
|---|---|---|---|
| 2,888,542 | 5/1959 | Mork | 219/10.55 F |
| 3,881,027 | 4/1975 | Levinson | 219/10.55 E |
| 4,093,841 | 6/1978 | Dills | 219/10.55 B |
| 4,103,431 | 8/1978 | Levinson | 219/10.55 E |
| 4,481,395 | 11/1984 | Smith et al. | 219/10.55 E |
| 4,506,127 | 3/1985 | Satoh | 219/10.55 B |
| 4,626,643 | 12/1986 | Minet | 219/10.55 B |
| 4,751,357 | 6/1988 | Boulard | 219/10.55 F |
| 4,822,966 | 4/1989 | Matsubara | 219/10.55 F |
| 4,835,354 | 5/1989 | Collins et al. | 219/10.55 B |

*Primary Examiner*—Philip H. Leung
*Attorney, Agent, or Firm*—Joseph B. Taphorn

[57] ABSTRACT

A high speed microwave high temperature oven system mounts an enclosed furnace in its cavity and extends a temperature probe therein. A controller regulates the furnace temperature by periodically interrupting over a range, the operation of the magnetron as the furnace or actual temperature approaches the setpoint. It interrupts the operation of the magnetron for longer periods of time as the actual temperature nears the setpoint. If the actual temperature exceeds the setpoint, the operation of the magnetron is interrupted for even longer periods of time. The controller at a selected furnace temperature also activates an exhaust function to remove hot air, smoke and fumes from and draw clean air into the furnace. As the actual temperature lowers towards the setpoint, the controller shortens the period of magnetron operation interruption. When the furnace temperature cools to a safe temperature, the controller shuts off the exhaust function. The range of periodic operation of the magnetron is automatically adjusted on a large difference between the actual temperature and the setpoint temperature. The range may also be shifted if the stable point temperature differs from the set point. The furnace is a box-like structure having a removable front door, and is formed of ceramic materials. Silicon carbide tiles within the furnace absorb microwave radiation to heat up the furnace.

10 Claims, 5 Drawing Sheets

HIGH HEAT MICROWAVE OVEN SYSTEM WITH TEMPERATURE SENSOR

This is in part a continuation of patent application Ser. No. 07/726,366 filed Jul. 5, 1991 and being abandoned.

FIELD OF THE INVENTION

This invention relates to high heat microwave oven systems and more particularly to a high speed high heat microwave oven system; in other words to a system wherein the ashing or loss on ignition time is drastically reduced.

STATE OF THE PRIOR ART

Prior art includes patents to Maeda et al (4,307,277); and to Collins et al (4,565,669). Maeda et al show a furnace within a microwave oven. Collins et al show a particular support for ashing materials in a microwave oven.

SUMMARY OF THE INVENTION

It is an object of the invention to provide a high speed, high heat microwave oven system; that is one wherein the ashing or heat loss on ignition times are drastically reduced.

It is a further feature of the invention to provide a high speed, high heat microwave system and method wherein successive batches or sets of samples can be heated and cooled rapidly.

It is another object of the invention to provide a high heat microwave oven system that is inexpensive of construction and easy of manufacture.

These and other objects, features and advantages of the inventions are achieved by combining a temperature probe with a unique ceramic furnace through which air is moved at optimal rates and in advantageous paths. A temperature controller responds to the sensing of the temperature probe extending into the ceramic furnace, to control the operation of a magnetron radiating the cavity of the microwave oven and the furnace placed therein. The furnace essentially is a box-like configuration having a removable door at its front end and incorporates in its side walls near the floor and forward end two openings for the ingress of air into the closed furnace. Air is drawn through the furnace and out of the back end thereof by an opening in its rear wall which is opposite an opening in the rear wall of the oven cavity and that is connected to suitable air exhausting means. Plugs of different porosity may be placed in the furnace openings just mentioned to further regulate air flow.

A feature of the invention is that the operator can insert or remove the furnace without disassembly of the furnace. This is very important as the interior of the furnace and its contents may be at a very high temperature at the end of the ashing cycle and it would be very difficult to remove the furnace if it had to be disassembled to remove it from the microwave cavity. The removal of the entire furnace is enabled by mounting the temperature probe rigidly to the rear wall of the cavity so that it extends horizontally forward and is received in the furnace via an opening in its rear wall as the furnace is slid into the cavity. The easy removal and insertion feature enables rapid processing of successive samples or sets of samples.

BRIEF DESCRIPTION OF THE SEVERAL DRAWING VIEWS

These and other objects, features and advantages of the invention will become apparent from a consideration of the following specification when considered with the appended drawings wherein.

DETAILED DESCRIPTION OF A PREFERRED EMBODIMENT OF THE INVENTION

Figure 1:
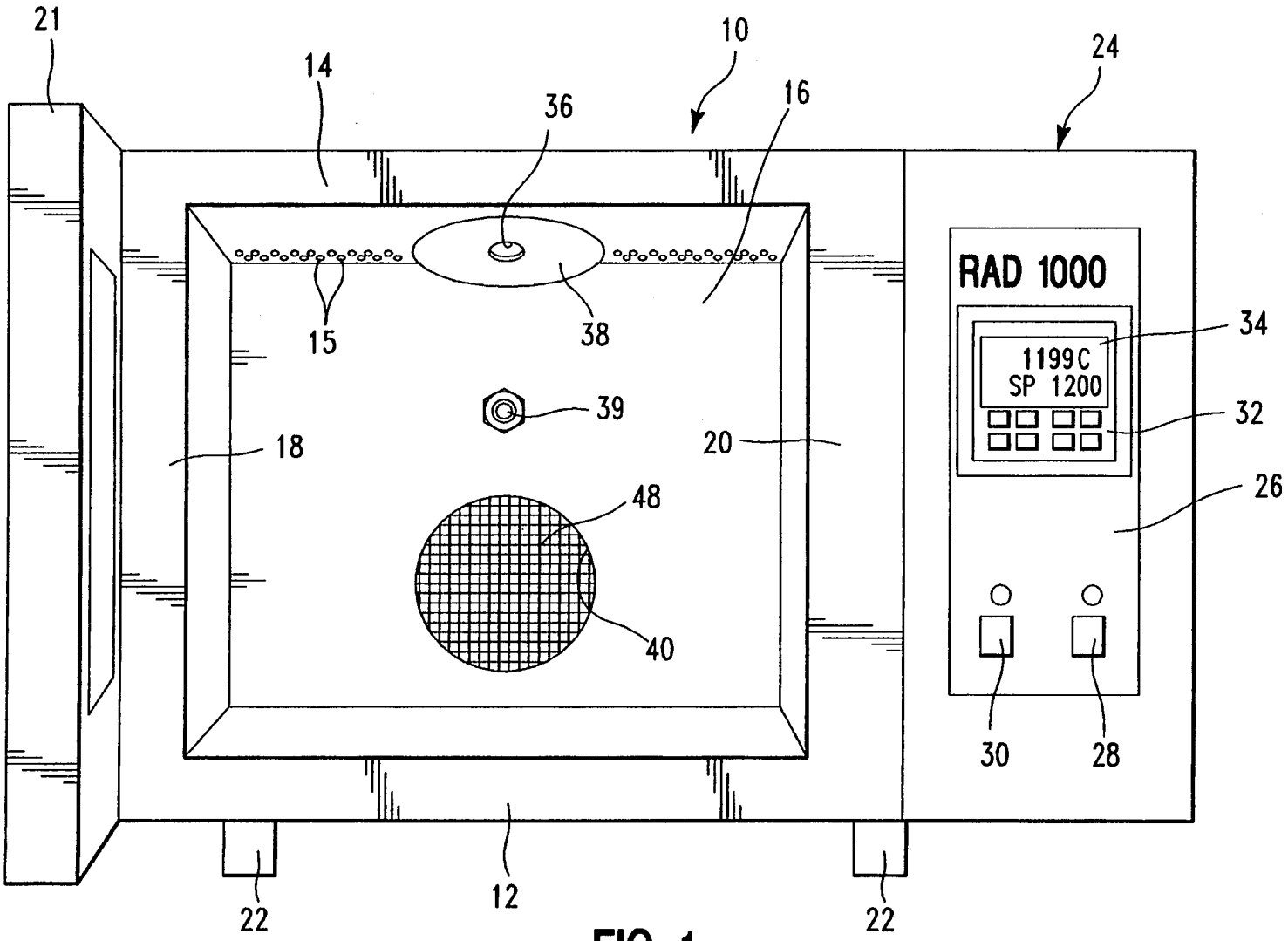
FIG. 1 is a view in perspective of a specially adapted microwave oven with the oven door open to show the interior of the oven cavity, and showing the control panel with its key pad.

The microwave oven used in the present invention may as shown in FIG. 1 include a section 10 providing the oven cavity defined by a floor 12, a ceiling 14 having a plurality of air inlet openings 15, a rear wall 16, left and right side walls 18 and 20, and hinged door 21. Blocks 22 on the underside of the floor 12 support the oven on a table top or the like. A right-hand section 24 includes a control panel 26 with its start and stop switches 28 and 30 and key pad 32 together with an electronic display 34. The right-hand section 24 houses in back of the control panel 26 a conventional magnetron and blower and a standard controller which will be hereinafter discussed. The magnetron in the right-hand section 24 is connected by a conventional wave guide to an outlet 36 in the wave guide diffuser 38 mounted on the ceiling 14 of the oven cavity.

The rear wall for the oven cavity mounts slightly above the center of the rear wall 16, a forwardly extending temperature probe 39 in the form of a type K thermocouple housed in an Inconel sheath. The probe extends horizontally forward in the oven about six inches. Below the probe, the rear wall 16 of the cavity has an enlarged air-outlet opening 40 covered with a perforated metal screen 48 to preclude the loss of microwave radiation therethrough. The outside of the rear wall 16 mounts over the opening 40 a flange 42 (FIG. 4) to which an exhaust hose which leads to separate exhaust fan maybe attached. Air enters the microwave oven cavity through the plurality of air inlet openings 15 in the ceiling 14. (See FIG. 1).

Figure 2:
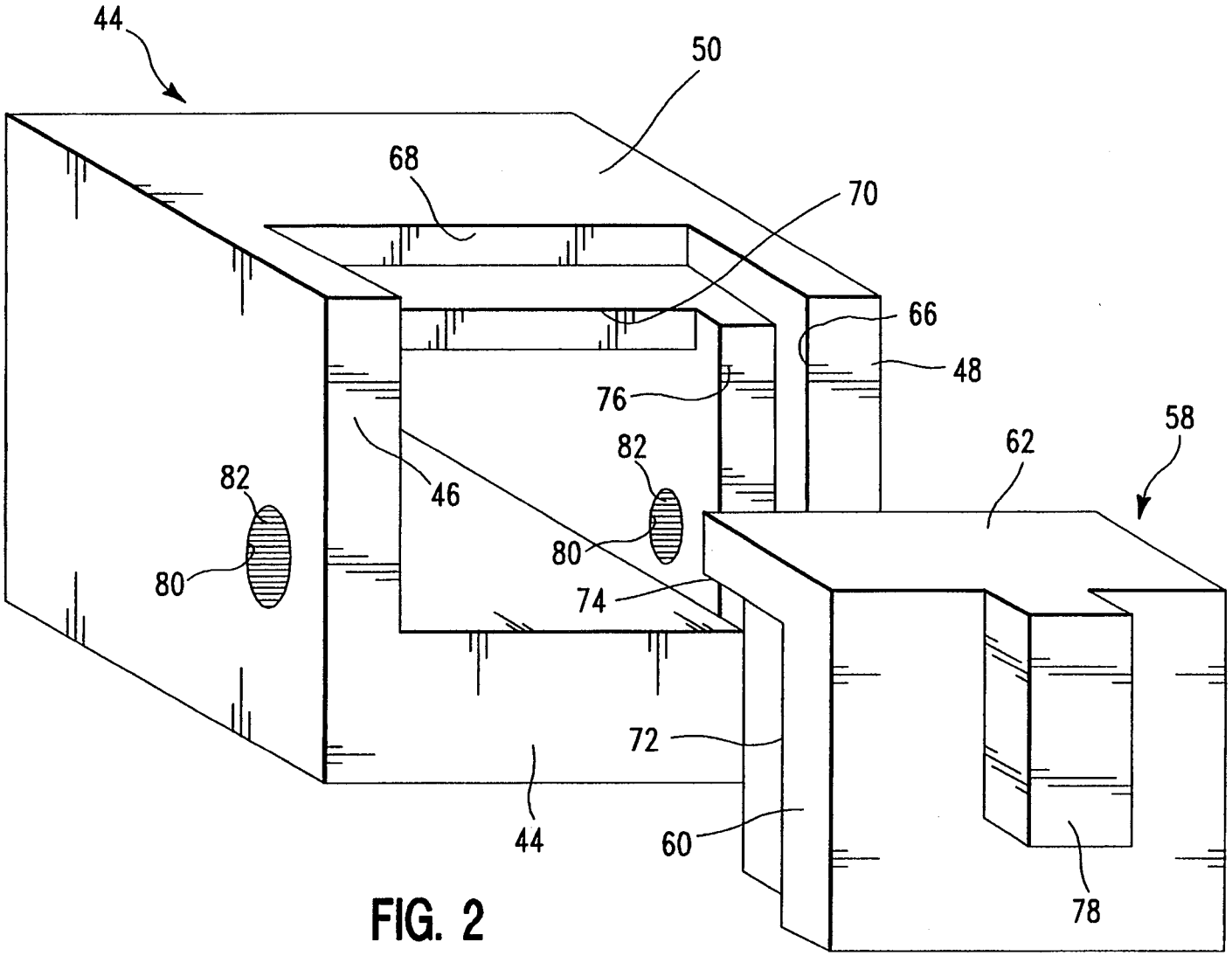
FIG. 2 is an exploded isometric view showing a furnace with its front door separated.
Figure 3:
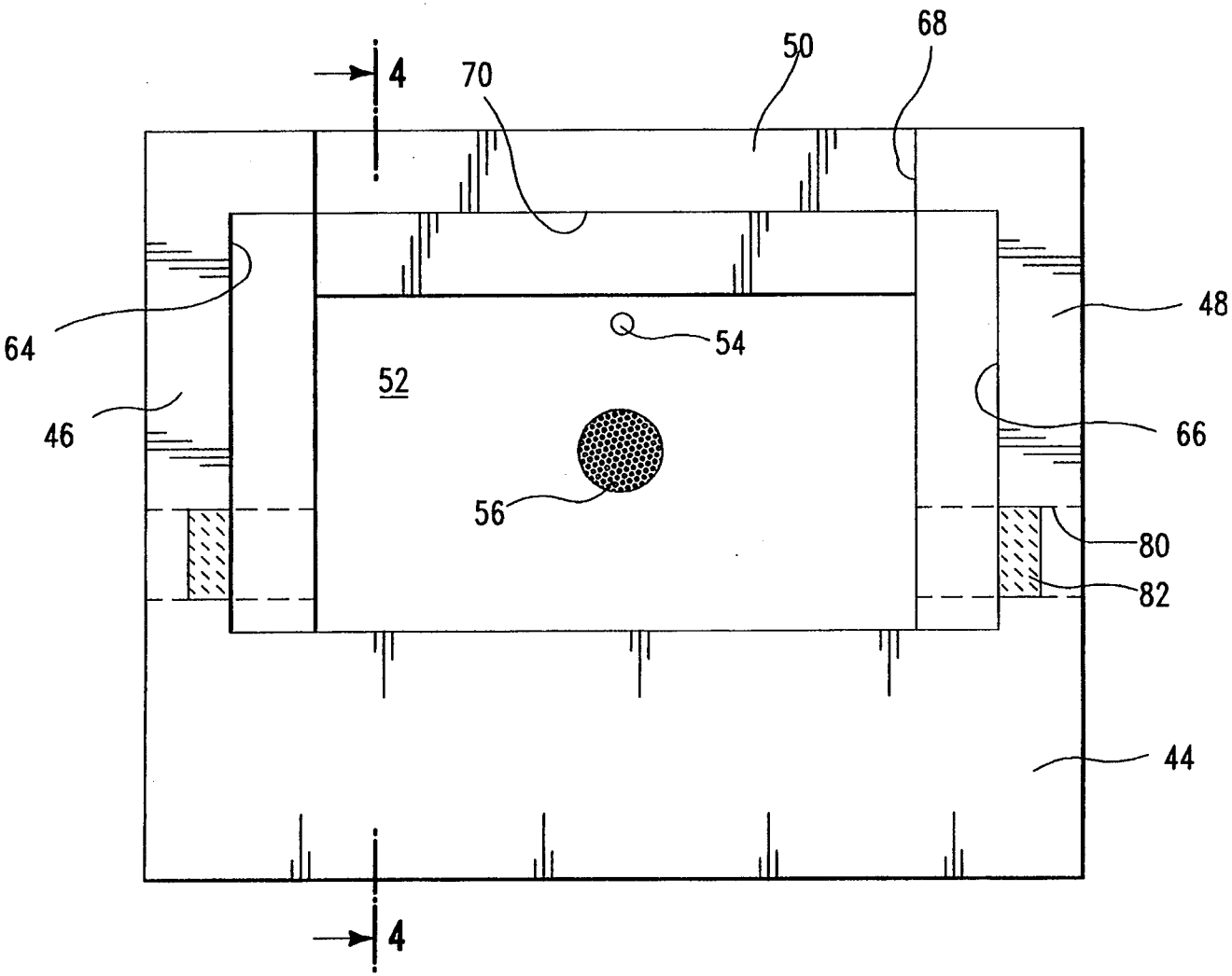
FIG. 3 is a front elevational view with the door removed, of the furnace of FIG. 2.
Figure 4:
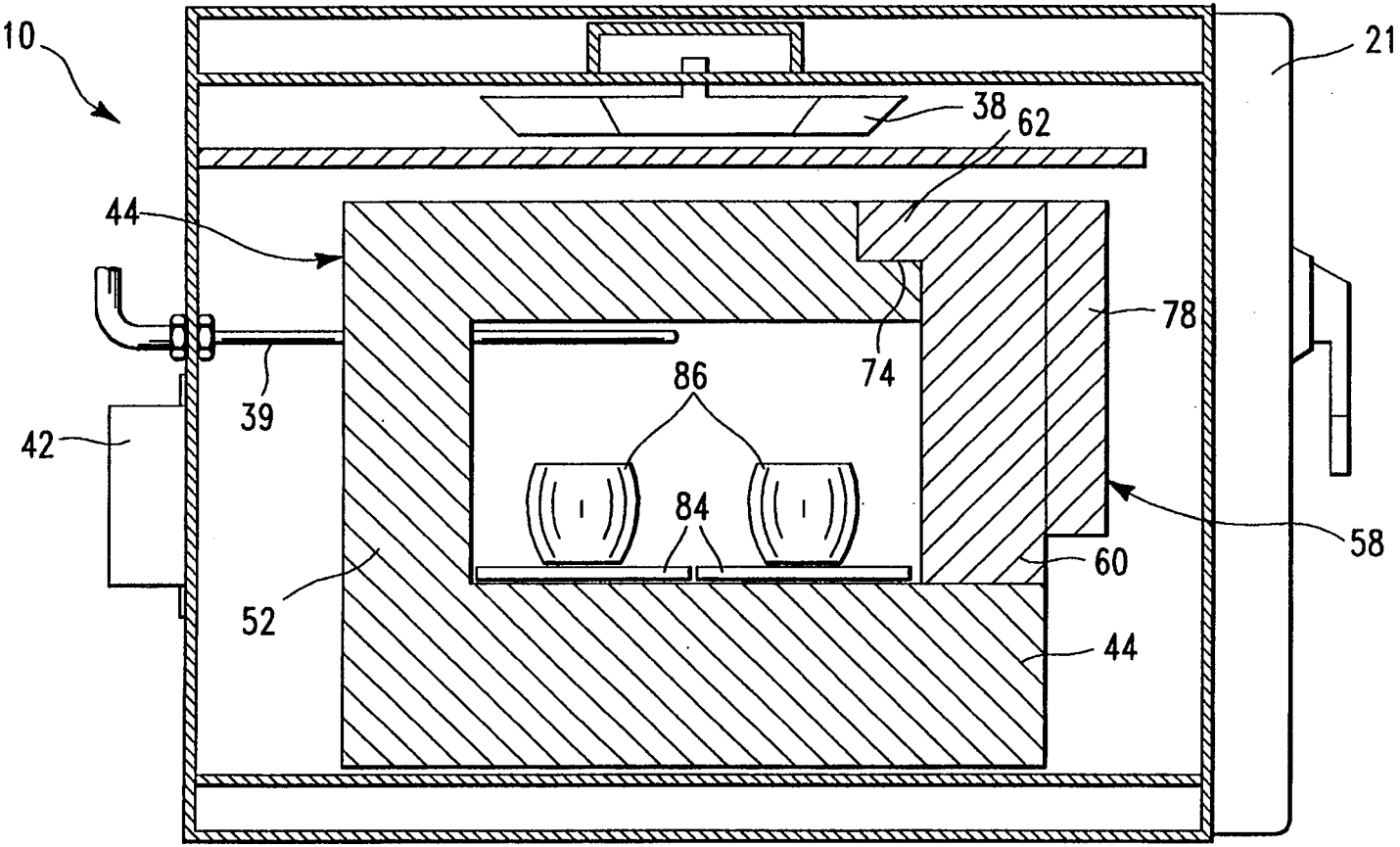
FIG. 4 is a sectional view of the microwave oven with the furnace installed, taken along the section line 4—4 of FIG. 3.

A furnace enclosure or furnace generally indicated by the numeral 44 and of a size to slide conveniently into the microwave cavity, is shown in FIGS. 1, 2, and 3. It consists of a box-like enclosure formed with a floor 44, left and right side walls 46 and 48, roof 50 and a rear wall 52 (FIGS. 3 and 4). Rear wall 52 is provided with an opening 54 to receive the temperature probe 39, and with an opening 56 which aligns with the opening 40 in the rear wall of the oven cavity to facilitate the exhaustion of air from the interior of the furnace.

The furnace includes a removable front door generally indicated by the numeral 58, for closing-off a large opening provided for ease of sample handling. The front door comprises a front wall 60 and a top portion 62. The dimensions of the door are such as to be received within cut-away portions of the sidewalls 46 and 48 and roof 50 of the furnace. Thus the left sidewall is cut-away at 64 and the right sidewall at 66 and the roof at 68 and further cut-away at 70. The removable front door 58 has its front portion 60 cut-away at each side at 72 and at top portion 62 cut-away at 74 and further at 76, to provide complementary mating surfaces sealing off the interior of the furnace when the removable door 58 is in place. The door may conveniently be put in place by grasping a protuberance 78 molded on the front of it.

With the door in place, air is admitted into the interior of the furnace through openings 80 formed in the lower and front ends with the side walls 46 and 48. Ceramic plugs 82 of selected porosity are placed in the openings 80 to help regulate the air flow through the furnace.

The furnace enclosure is fabricated of a ceramic material consisting of alumina (AL/20/3) and silica (Si-O/2) having appropriate quantities of organic and inorganic binders. Such material maybe purchased as a commercially available board known as B & W Kaowal 2600 Board. Such material exhibits volume stability at elevated temperatures. It also has resistance to chemical attack and is unaffected by oil and water. If wetted, its thermal and physical properties can be restored by drying. Ceramic fiber material is transparent to microwave radiation while resistant to the transfer of heat. The small amounts of organic combustible binder will burn out at 300 degrees F. (Thus adequate ventilation should be provided during initial heating to avoid flash ignition of the binder outgassing.)

The interior of the furnace is heated during microwave oven radiation operation by microwave absorptive heater elements or plates 84 placed therein. As best seen in FIG. 4, heater elements or plates 84 maybe laid on the floor 44 of the furnace. The heater elements or plates 84 are formed of a high loss, that is, microwave radiation absorbing, material. The material heats up to a particular temperature, and a material is selected that provides the necessary temperature; the necessary temperature being somewhat higher than the system operating temperature. Preferred materials for ashing are silicon carbide or zirconium-based ceramics. Silicon carbide blocks manufactured by Norton Company of Worcester, Mass., for use as sharpening stones, may be used as the heating elements. Though the heating elements have been shown as plates or tiles 84 on the floor 44 of the oven, it would be quite feasible to line the whole inside of the furnace including the walls and ceilings with heating elements. The ceramic fiber walls of the furnace are impervious to heat transfer and hence contain the heat generated by the heater elements therein.

As shown in FIG. 4, crucibles holding material to be subjected to a high heat, may be placed directly on the heating elements 84. They may be formed of solid quartz or a high temperature ceramic. They may be left open or lightly covered as best suits the application.

The correct temperature operation of the system is governed by a standard controller providing proportional with integral and derivative (PID) control. Computer controllers in their simplest form provide an on/-off signal to the magnetron when the temperature crosses a setpoint. (The setpoint is the temperature at which it is desired to run a given operation.) Since the temperature must cross the setpoint to cause such a controller to change the output signal, the operation temperature cycles continually, going from a temperature below the setpoint to one above and then back again.

Proportional control eliminates some of the cycling associated with on-off control. A proportional controller decreases the average power being supplied to the magnetron and hence to the heater elements 84 as the temperature approaches the setpoint; this causes the system to overshoot the setpoint less, approaching it more slowly; hence a more stable temperature obtains for the operation. Proportional action is accomplished by turning microwave-oven magnetron on and off for short periods; the proportioning action occurs within a proportional band or range about the setpoint temperature. When the system operation temperature is within the band, the output is turned on and off in the ratio of the system operation temperature difference from the setpoint. The on/off ratio is decreased even more when the system operational temperature exceeds the setpoint, to bring the operational temperature back to the setpoint.

Derivative control provides the controller with the ability to shift the proportional band for another reason—to compensate for rapidly changing temperature. A rapidly rising operational temperature brings the range into play at a lower temperature; a slowing changing temperature in effect compresses the range to bring it into play later. Thus, the amount of shift is proportional to the rate of temperature change.

Figure 5:
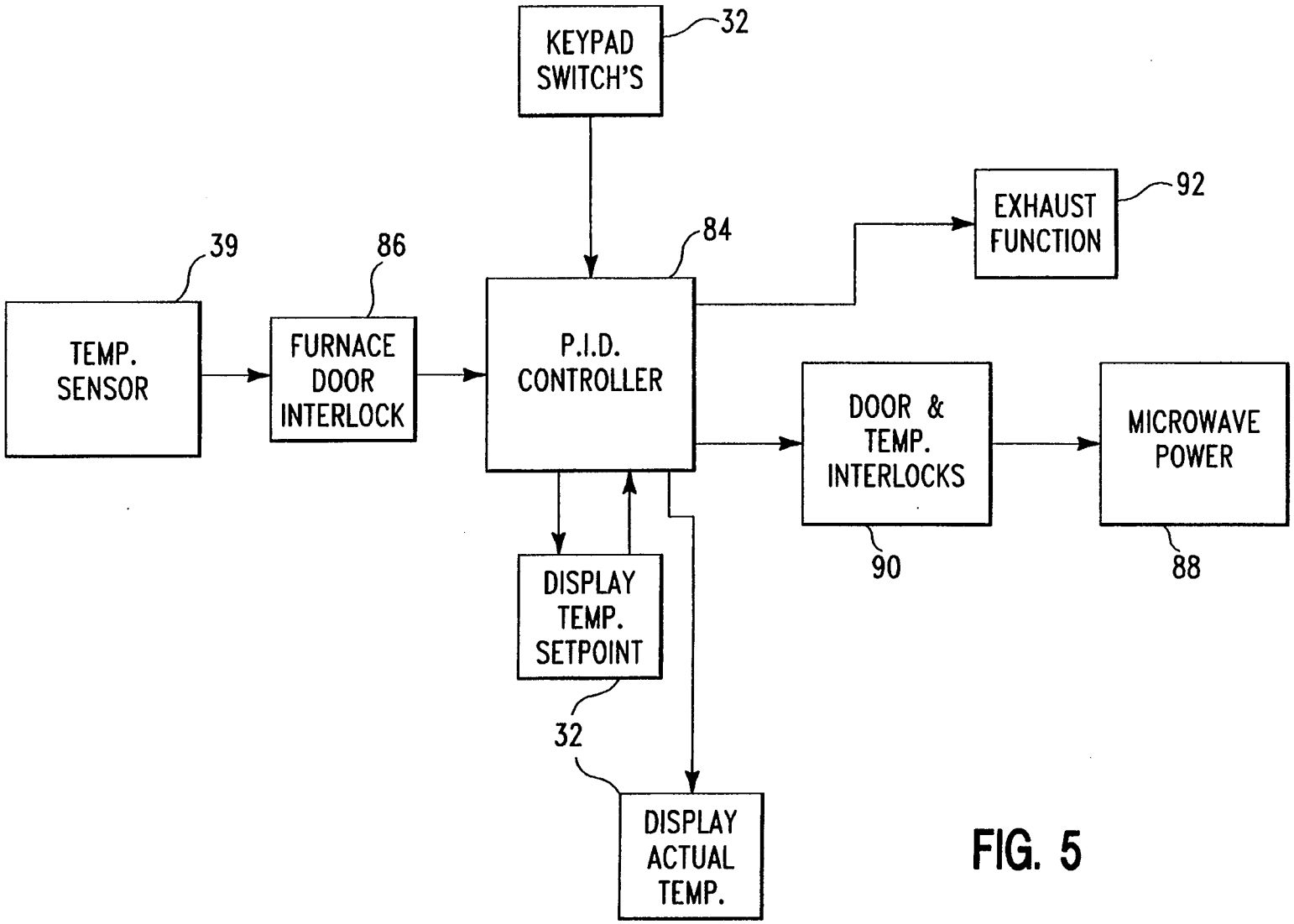
FIG. 5 is an electrical block diagram depicting the interaction of the high speed high heat microwave oven system components.

In FIG. 5, a commercially available PID type controller, the Omega programmable controller CN2010, is shown as being electrically connected through a furnace door interlock 86 with the temperature probe 39 extending into the furnace 44 from the back wall 16 of the microwave oven cavity. Through the key pad 32 of the microwave oven control panel 26, the set point temperature would be entered, and the controller would cause the oven display 34 to display it. Upon actuation of the start key 28 the controller would turn on the microwave-oven magnetron 88 through the door and temperature interlocks 90. When the temperature reached the proportional band range, the controller would begin turning off the magnetron 88 for short periods of time, the periods of off time gradually becoming longer as the setpoint temperature was approached. As the temperature change rate decreases, the derivative control would also shrink the proportional range to provide greater precision.

If the operation temperature proceeds to exceed the setpoint, the controller would turn off the magnetron for even greater time periods.

The controller 84 would also have, at a preselected temperature lower than the set point temperature, turned on the exhaust function (such as a fan) 92 connected to the flange 42 for the microwave oven outlet 40. This to exhaust all smoke and fumes from the furnace when samples start to burn, through the furnace opening 56, and to draw clean air into the furnace via its openings 80 from the oven cavity supplied with clean air via its ceiling openings 15. The controller also automatically shuts off the exhaust function when the furnace cools to a safe temperature. The exhaust function is readily detachable which permits exchanging it on breakdown and eliminates expensive field service calls and down-time for factory repairs.

The controller 84 also features a RAMP function (a capability to control the temperature, that is, change the setpoint, over time); and a SOAK function (a capability to provide another setpoint temperature for a period of time). In addition it has program memory and automatic tuning. It displays alarms, the outputs, and the operating status simultaneously. Automatic tuning (resetting the controller when the system temperature returns to within the limit bandwidth set) and the PID controller provide for temperature repeatability plus or minus one degree centigrade. RAMP and SOAK function will heat the furnace at desired rates, hold the temperature for certain times and also regulate the cool down cycle. The tuning and the RAMP and SOAK functions are stored in memory for subsequent tasks.

In use, crucibles containing material to be heated to a high temperature such as in ashing would be placed in the furnace, the furnace door 58 put in place, and the oven door 21 closed. The start button 28 would be pushed to activate the controller 84, and the controller will initiate the operation of the magnetron 88. As the temperature of the furnace is sensed by the probe 39 as coming within the proportional range in approaching the setpoint, it will periodically interrupt the operation of the magnetron 88 to decrease the heating of the tiles 84 in the furnace. As the temperature comes closer to the setpoint the interruption periods will be greater.

If the temperature exceeds the setpoint, the interruption periods will be even larger until the temperature rise ceases.

The controller 84 also automatically shuts off the exhaust function when the furnace cools to a safe temperature.

The controller will display the actual temperature in the furnace along with the setpoint temperature. If the stable temperature in the controller is observed to be offset from the setpoint temperature, appropriate adjustments can be made to move the stable temperature to the setpoint temperature. The integral function can do this automatically after the system stabilizes.

An extra fine temperature control is achieved in the system by inserting plugs 82 of different porosity in furnace air inlet openings 80 and air outlet opening 40. These plugs may be of a reticulated ceramic material such as lithium, alumina, and silicate. A satisfactory alumina (AL/2 O/3) is manufactured by Hi-Tech Ceramics, Inc. of Alfred, N.Y., and sold under the trademark RETICEL. By using more porous plugs, or shorter length plugs of the same porosity, increased air flow is enabled. Conversely, by using less porous plugs, or longer length plugs of the same porosity, decreased air flow is enabled. Thus the impact of the exhaust fan operation upon furnace temperature can be adjusted to suit operational requirements. For example, when testing products that require large volumes of air to ash properly, plugs with larger or a greater number of pores or of shorter length, may be employed. On the other hand for products that require small amounts of air to ash properly, plugs with smaller or less pores or greater length, may be used to conserve heat and effect rapid heat ups.

A feature of the invention is that the temperature sensor having the probe 39 extending horizontally forward from the rear wall straight into the center of the oven cavity, and the ceramic furnace 44 having an opening 56 in its rear wall for receiving the probe, enable the furnace 44 to be pushed straight back into the oven cavity directly from the front. Thus the ceramic furnace 44 does not have to be dismantled in any way to install or to remove it. Because of this the furnace parts can be adhered to or cemented together to fabricate a permanent finished assembly.

It will be evident that applicant has provided a high temperature microwave oven system wherein the oven can be rapidly brought to a high temperature and held at that temperature while expending only the minimum amount of energy. Temperature overshoot is minimized! The few moving parts and the absence of a need to disassemble the parts, makes for many long years of trouble free service.

It will be manifest that because the temperature probe is fixed rigidly to the rear wall of the cavity and extends horizontally forward therefrom, and because the furnace is formed with an opening in its rear wall to receive the probe when the furnace is slid into the cavity, that an operator can insert or remove the furnace without any disassembly of the furnace. This is important as the interior of the furnace may be at a very high temperature at the end of the ashing cycle, and it would therefore be difficult to remove the furnace while hot if it had to be disassembled to remove it from the microwave cavity.

It is frequently desirable to remove the entire furnace while still hot so that a cool furnace in which samples are to be microwave heated from room temperature, may immediately be employed. (If the operator has to wait for the furnace to cool between processing samples or sets of samples, it greatly reduces the number of times the microwave cavity can be cycled each work shift.) Sometimes it is also desirable to remove a hot furnace to enable the sample or samples therein and it to be placed in a desiccator without exposing the sample or samples directly to the moisture in the ambient air. Usually after the operator removes a hot furnace, he or she will immediately insert another, cool furnace and run another sample or sets of samples.

With applicant's system, an operator can either open the furnace door and remove the sample or samples and then remove the furnace, or he or she can remove the furnace with the sample or samples inside. Since it is usually necessary to move the samples to a desiccator to cool before weighing, it would require a desiccator large enough to place the entire furnace in if the operator wished to leave the samples within the furnace while they cool. For that reason, and to achieve the most rapid cooling, the operator would normally remove the sample from the furnace in the oven and place the sample in the desiccator, and then remove the furnace to let it cool.

Hence the normal procedure for using applicant's high speed, high heat microwave system would be for the operator to place a cool furnace into the microwave cavity, insert a sample or set of samples into the furnace, close the furnace and oven doors, operate the oven, open the oven and furnace doors, remove the samples or set of samples from the furnace, remove the furnace from the oven, install another cool furnace, place another sample or set of samples in the furnace, close the furnace and oven doors, operate the oven, etc.

A major advantage of a removable furnace is that samples requiring low starting temperatures can be run serially without waiting for the just heated furnace to cool.

The invention is obviously inexpensive and easy of manufacture. Only commercially available materials and components are required.

It will be appreciated that while applicant has described the invention with respect to a preferred embodiment, other embodiments and utilizations of the principles of the invention will be apparent to those skilled in the art. Accordingly it is intended to be limited only by the spirit or scope of the appended claims.

What is claimed is:

1. A microwave oven system for heating materials to a high heat comprising an oven having a cavity and a magnetron, wherein the system can operate at a selected high heat setpoint temperature, a furnace within said cavity, microwave absorptive heater elements within said furnace, and means for automatically controlling the temperature in said furnace by adjusting the operation of the magnetron, wherein the temperature controlling means includes a temperature sensor in the furnace, wherein the temperature controlling means includes a controller responsive to the temperature sensor to adjust the operation of the magnetron, wherein the controller includes means limiting the operation of the magnetron as the furnace approaches the setpoint, wherein the controller includes means limiting the operation of the magnetron by interrupting its operation for periods of time, wherein the controller interrupting means includes means increasing the periods in length as the actual temperature approaches the setpoint temperature.

2. A microwave oven system for heating materials to a high heat comprising an oven having a cavity and a magnetron, wherein the system can operate at a selected high heat setpoint temperature, a furnace within said cavity, microwave absorptive heater elements within said furnace, and means for automatically controlling the temperature in said furnace by adjusting the operation of the magnetron, wherein the temperature controlling means includes a temperature sensor in the furnace, wherein the temperature controlling means includes a controller responsive to the temperature sensor to adjust the operation of the magnetron, wherein the controller includes means limiting the operation of the magnetron as the furnace approaches the setpoint, wherein the controller includes means limiting the operation of the magnetron by interrupting its operation for periods of time, wherein the controller interrupting means includes means decreasing the periods in length as the actual temperature approaches the setpoint temperature from above the set point.

3. A microwave oven system for heating materials to a high heat comprising an oven having a cavity and a magnetron, a furnace within said cavity, microwave absorptive heater elements within said furnace, and means for automatically controlling the temperature in said furnace by adjusting the operation of the magnetron, wherein the system can operate at a selected high heat setpoint temperature, wherein the system may have a stable point temperature offset from the setpoint temperature, wherein the temperature controlling means includes a temperature sensor in the furnace, wherein the temperature control means includes a controller responsive to the temperature sensor to adjust the operation of the magnetron, wherein the controller includes means limiting the operation of the magnetron as the furnace approaches the setpoint, wherein the controller includes means limiting the operation of the magnetron by interrupting its operation for periods of time, wherein the controller includes means limiting the operation of the magnetron over a temperature range, wherein the controller means includes means extending the range over which the operation of the magnetron is interrupted to each side of the setpoint, wherein the controller includes means shifting the range if the stable point temperature is offset from the setpoint.

4. A microwave oven system for heating materials to a high heat comprising an oven having a cavity and a magnetron, wherein the system can operate at a selected high heat setpoint temperature, a furnace within said cavity, microwave absorptive heater elements within said furnace, and means for automatically controlling the temperature in said furnace by adjusting the operation of the magnetron, wherein the temperature controlling means includes a temperature sensor in the furnace, wherein the temperature controlling means includes a controller responsive to the temperature sensor to adjust the operation of the magnetron, wherein the controller includes means limiting the operation of the magnetron as the furnace approaches the setpoint, wherein the controller includes means limiting the operation of the magnetron by interrupting its operation for periods of time, wherein the controller includes means limiting the operation of the magnetron over a temperature range, wherein the controller means includes means automatically extending the range when the actual temperature differs from the setpoint temperature so as to lie outside of the range.

5. A microwave oven system for heating materials to a high heat comprising an oven having a cavity and a magnetron, a furnace slid within said cavity, microwave absorptive heater elements within said furnace, wherein the furnace includes sides and a back wall and air outlet openings and a temperature sensor probe extending forwardly from the back wall, and means for automatically controlling the temperature in said furnace by adjusting the operation of the magnetron, wherein the furnace is a boxlike structure having a front opening and a door closing the opening, wherein the furnace has openings suitably located to permit the passage of air therethrough and to receive the temperature sensor probe when the furnace is slid into the cavity, wherein the openings are at the lower front sides of the furnace and the air outlet opening is in the center of the back wall.

6. A microwave oven system according to claim 5, and an air exhaust opening in the back wall of the oven cavity that is aligned with the furnace air outlet opening and covered with a perforated metal screen.

7. A microwave oven system according to claim 5, wherein a plug or plugs of selected porosity are placed in one or more of the furnace openings to regulate air flow through the furnace.

8. A microwave oven system according to claim 5, and an air exhaust function connected to the air outlet opening, the means for automatically controlling activating the air exhaust function when the temperature exceeds a predetermined point.

9. A microwave oven system for heating materials to a high heat comprising an oven having a cavity, a back wall and a magnetron, a furnace having a rear wall within said cavity, microwave absorptive heater elements within said furnace, and means for automatically controlling the temperature in said furnace by adjusting the operation of the magnetron, wherein the temperature controlling means includes a temperature sensor projecting forward from the oven back wall in the furnace, wherein the furnace includes an opening in its rear wall for receiving the temperature sensor as the furnace is placed within the cavity.

10. A microwave oven system for heating materials to a high heat comprising an oven having a cavity and a magnetron, a furnace within said cavity, said oven having a back wall and said furnace a rear wall, microwave absorptive heater elements within said furnace, and means for automatically controlling the temperature in said furnace by adjusting the operation of the magnetron, wherein the temperature controlling means includes a temperature sensor in the furnace, wherein the temperature sensor is a probe extending horizontally forward from the back wall of the oven and the furnace includes an opening in its rear wall for receiving the probe as the furnace is placed within the oven.

* * * * *